US006764435B1

(12) United States Patent
Hennessy

(10) Patent No.: US 6,764,435 B1
(45) Date of Patent: Jul. 20, 2004

(54) ADVANCED FOOD CONTAINERS

(76) Inventor: Joseph J. Hennessy, E5294 Ohio Rd., Loganville, WI (US) 53943

( * ) Notice: Subject to any disclaimer, the term of this patent is extended or adjusted under 35 U.S.C. 154(b) by 0 days.

(21) Appl. No.: 10/379,891

(22) Filed: Mar. 5, 2003

Related U.S. Application Data

(60) Provisional application No. 60/368,691, filed on Mar. 27, 2002.

(51) Int. Cl.[7] ..... B31B 9/00

(52) U.S. Cl. ..... 493/52; 493/108; 493/109; 493/139; 493/901

(58) Field of Search ..... 493/52, 108, 109, 493/114, 116, 137, 139, 480, 901, 908; 206/551

(56) References Cited

U.S. PATENT DOCUMENTS

| | | | | | |
|---|---|---|---|---|---|
| 2,036,928 | A | * | 4/1936 | Dreux et al. | 229/123.2 |
| 2,172,179 | A | * | 9/1939 | Rutledge | 229/5.5 |
| 2,262,292 | A | * | 11/1941 | Ladd | 493/108 |
| 2,296,808 | A | * | 9/1942 | Chaplin | 229/406 |
| 3,083,888 | A | * | 4/1963 | Miller | 229/400 |
| 3,404,798 | A | * | 10/1968 | Hurwitz | 220/362 |
| 3,547,012 | A | * | 12/1970 | Nicholas et al. | 493/109 |
| 3,933,295 | A | * | 1/1976 | Congleton | 229/406 |
| 4,187,768 | A | * | 2/1980 | Suzuki | 493/109 |
| 4,201,301 | A | | 5/1980 | Aggio | 206/507 |
| 4,531,930 | A | * | 7/1985 | Clauss | 493/108 |
| 5,669,552 | A | | 9/1997 | Watanabe | 229/114 |

* cited by examiner

*Primary Examiner*—Eugene Kim
*Assistant Examiner*—Sameh Tawfik
(74) *Attorney, Agent, or Firm*—Donald J. Ersler

(57) ABSTRACT

An advanced food container includes a ring frame, a bottom panel and a removable lid. The ring frame includes a tapered wall with a bottom support surface disposed at substantially a bottom thereof and a lid support surface disposed at substantially at top thereof. The bottom support surface is sized to receive the outer perimeter of the bottom panel and the lid support surface is sized to receive the outer perimeter of the removable lid. In a first embodiment, the bottom panel and removable lid are retained with at least two retention projections. In a second embodiment, the bottom panel and removable lid are retained with a plurality of retention protrusions. In a third embodiment, the bottom panel is retained with adhesive and the removable lid is retained with at least one piece of tape. In a fourth embodiment, the bottom panel and removable lid are retained in slots.

14 Claims, 10 Drawing Sheets

ADVANCED FOOD CONTAINERS

1. CROSS-REFERENCES TO RELATED APPLICATIONS

This is a utility patent application, taking priority from provisional patent application, Serial No. 60/368,691 filed on Mar. 27, 2002.

BACKGROUND OF THE INVENTION

2. Field of the Invention

The present invention relates generally to food containers and more specifically to advanced food containers, which are fabricated using less material and may be assembled in less time than comparable prior art food containers.

3. Discussion of the Prior Art

Presently, retail food outlets utilize square corrugated paperboard food boxes for transport and delivery of food items such as pizza or pies. Pizzas and pies are generally round, therefore square corrugated paperboard food boxes are constructed with a significant amount of unused material, which creates unneeded waste. The square corrugated paperboard food box must also be folded into shape before use which causes an unneeded waste of time and cost to the food outlet.

Attempts have been made to decrease the amount wasted time and material required to fabricate food containers, while maintaining desirable thermal and structural characteristics. There have been at least two patents directed at providing an alternative to the square corrugated paperboard food box. For example, U.S. Pat. No. 4,201,301 Aggio discloses a generally round container for the storage of a pizza. The Aggio invention does reduce material. However, Aggio abandons a corrugated paperboard base panel, which would normally act as a thermal barrier on the base of the food container.

Another example is U.S. Pat. No. 5,669,552 Watanabe. Watanabe discloses an octagon shaped corrugated paperboard container for the storage of food items. The Watanabe invention reduces material and allows for more storage freedom to the food outlet. However, Watanabe may not be simple to manufacture.

Accordingly, the object of the present invention is to provide advanced food containers, which use less material, allow for rapid assembly and can be more easily stored than that of comparable prior art food containers, while maintaining significant structural and thermal reliability.

SUMMARY OF THE INVENTION

The present invention is an advanced food container, which is fabricated from less material than comparable prior art food containers, allows for rapid assembly and can be more readily stored than that of comparable prior art food containers. The embodiments of the present invention are differentiated from the prior art in that there are three separate parts as opposed to one or two parts found in many prior art food containers. The present invention includes a ring frame, a bottom panel and a removable lid. The ring frame may be constructed of a different material than the bottom panel and the removable lid.

A first embodiment of an advanced food container includes a ring frame, a bottom panel, and a removable lid. The ring frame includes a tapered wall with a bottom support surface disposed at substantially a bottom thereof and a lid support surface disposed at substantially at top thereof.

Preferably, at least one foot projection extends from a bottom of the ring frame. The bottom of the ring frame may be solid or an opening may be formed through the bottom. The perimeter of the ring frame may have a circular, oval, square, or any other appropriate shape. An outer perimeter of the bottom support surface is sized to receive the outer perimeter of the bottom panel and an outer perimeter of the lid support surface is sized to receive the outer perimeter of the removable lid. At least one bottom retention projection is formed above the bottom support surface to retain the bottom panel. At least one lid retention projection is formed above the lid support surface to retain the removable lid. The removable lid preferably includes a lifting tab.

A second embodiment of an advanced food container includes a ring frame, a bottom panel, and a removable lid. The ring frame includes a tapered wall with a bottom support surface disposed at substantially a bottom thereof and a lid support surface disposed at substantially at top thereof. Preferably, at least one foot projection extends from a bottom of the ring frame. The bottom of the ring frame may be solid or an opening may be formed through the bottom. The perimeter of the ring frame may have a circular, oval, square, or any other appropriate shape. An outer perimeter of the bottom support surface is sized to receive the outer perimeter of the bottom panel and an outer perimeter of the lid support surface is sized to receive the outer perimeter of the removable lid. A plurality of bottom retention protrusions are formed above the bottom support surface to retain the bottom panel. A plurality of lid retention protrusions are formed above the lid support surface to retain the removable lid. The removable lid preferably includes a lifting tab.

A third embodiment of an advanced food container includes a ring frame, a bottom panel, and a removable lid. The ring frame includes a tapered wall with a bottom support surface disposed at substantially a bottom thereof and a lid support surface disposed at substantially a top thereof. Preferably, at least one foot projection extends from a bottom of the ring frame. The bottom of the ring frame may be solid or an opening may be formed through the bottom. The perimeter of the ring frame may have a circular, oval, square, or any other appropriate shape. An outer perimeter of the bottom support surface is sized to receive the outer perimeter of the bottom panel and an outer perimeter of the lid support surface is sized to receive the outer perimeter of the removable lid. The bottom panel is attached to the bottom support surface with an adhesive or the like. The removable lid is retained on the lid support surface with at least one piece of tape or the like. The removable lid preferably includes a lifting tab.

A fourth embodiment of an advanced food container includes a ring frame, a bottom panel, and a removable lid. The ring frame includes a tapered wall with a bottom support surface disposed at substantially a bottom thereof and a lid support surface disposed at substantially at top thereof. Preferably, at least one foot projection extends from a bottom of the ring frame. The bottom of the ring frame may be solid or an opening may be formed through the bottom. The perimeter of the ring frame may have a circular, oval, square, or any other appropriate shape. The bottom panel includes a plurality of peripheral panel projections. The removable lid includes a plurality of peripheral lid projections. An outer perimeter of the bottom support surface is sized to receive a panel perimeter of the bottom panel and an outer perimeter of the lid support surface is sized to receive a lid perimeter of the removable lid. A plurality of panel slots are formed adjacent the bottom support surface and a plurality of lid slots are formed adjacent the lid support surface. The removable lid preferably includes a lifting tab.

Accordingly, it is an object of the present invention to provide an advanced food container, which is fabricated using less material than comparable prior art food containers.

It is a further object of the present invention to provide an advanced food container, which uses less material in construction than comparable prior art food containers, without sacrificing strength.

Finally, it is another object of the present invention to provide an advanced food container, which may be rapidly assembled.

These and additional objects, advantages, features and benefits of the present invention will become apparent from the following specification.

DETAILED DESCRIPTION OF THE PREFERRED EMBODIMENTS

Figure 1:
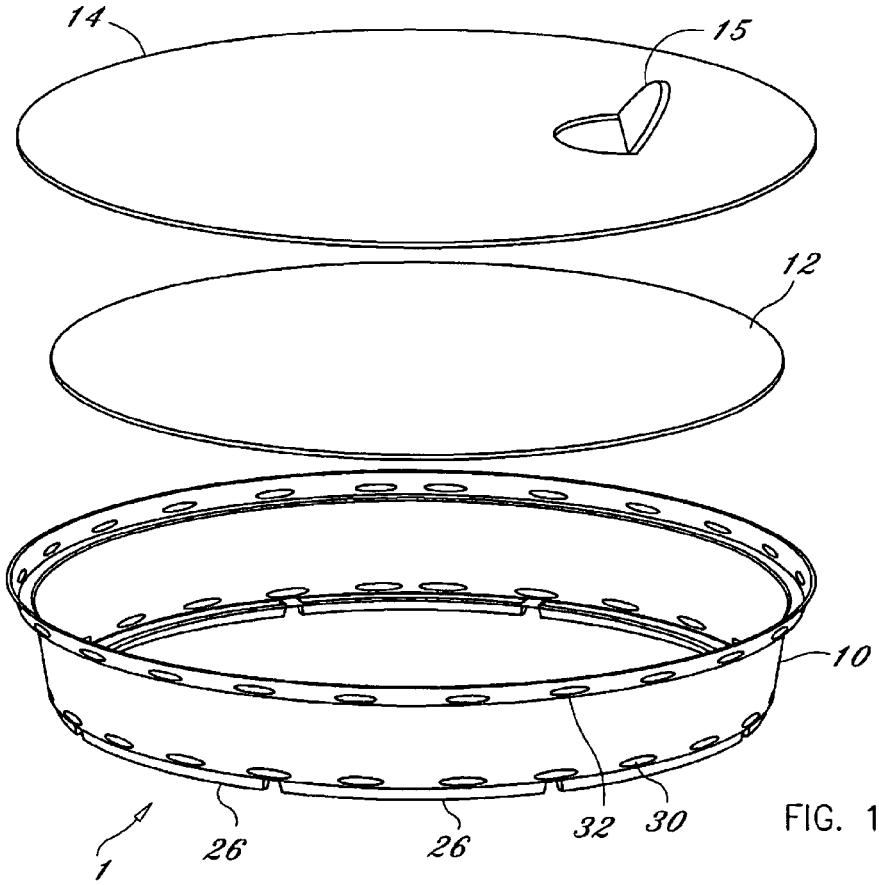
FIG. 1 is an exploded perspective view of a first embodiment of an advanced food container in accordance with the present invention.
Figure 2:
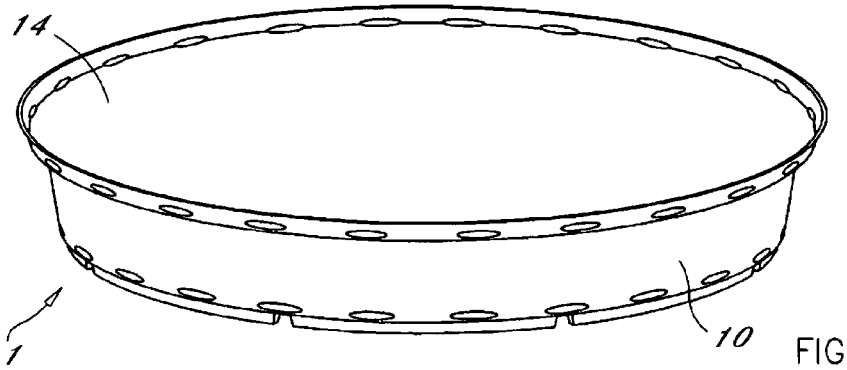
FIG. 2 is a perspective view of an assembled first embodiment of an advanced food container in accordance with the present invention.
Figure 3:
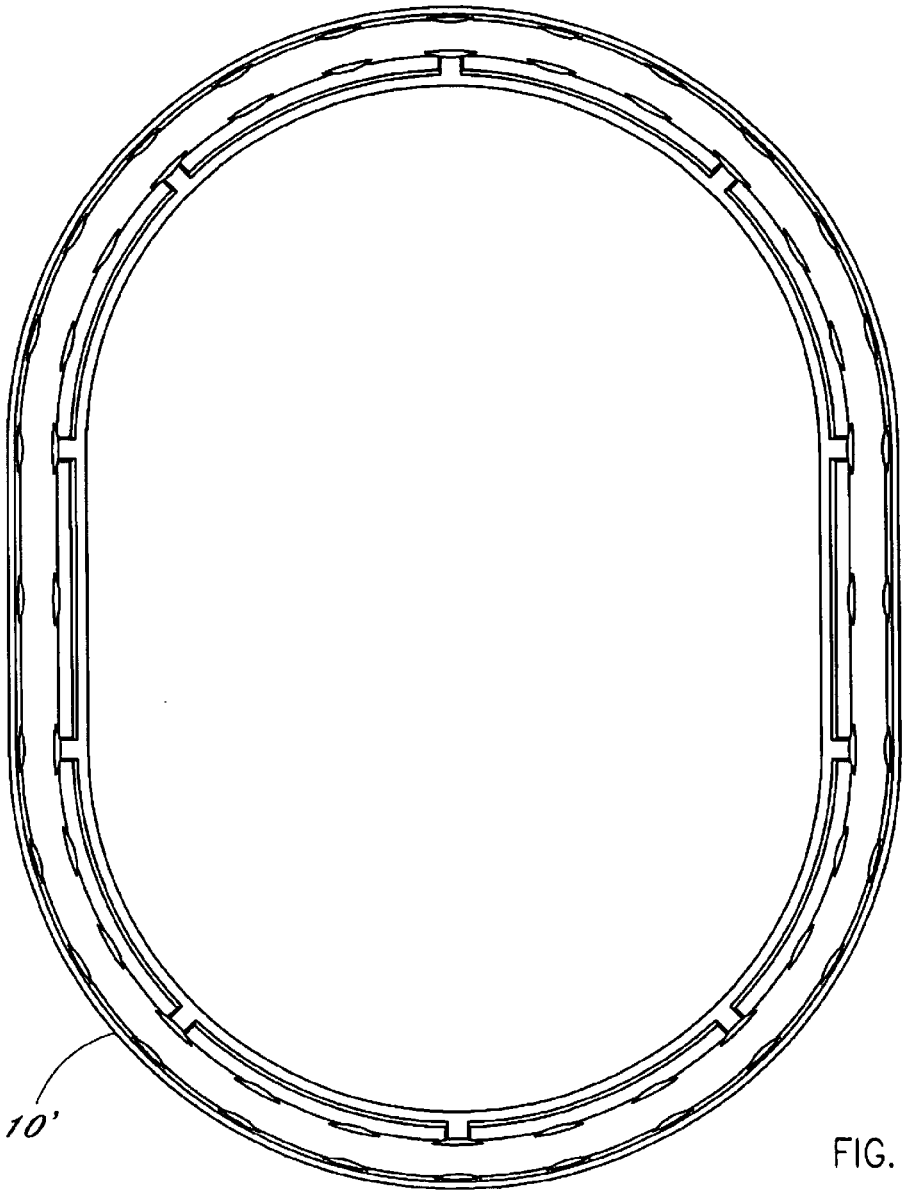
FIG. 3 is a top view of an oval shaped ring frame of a first embodiment of an advanced food container in accordance with the present invention.
Figure 4:
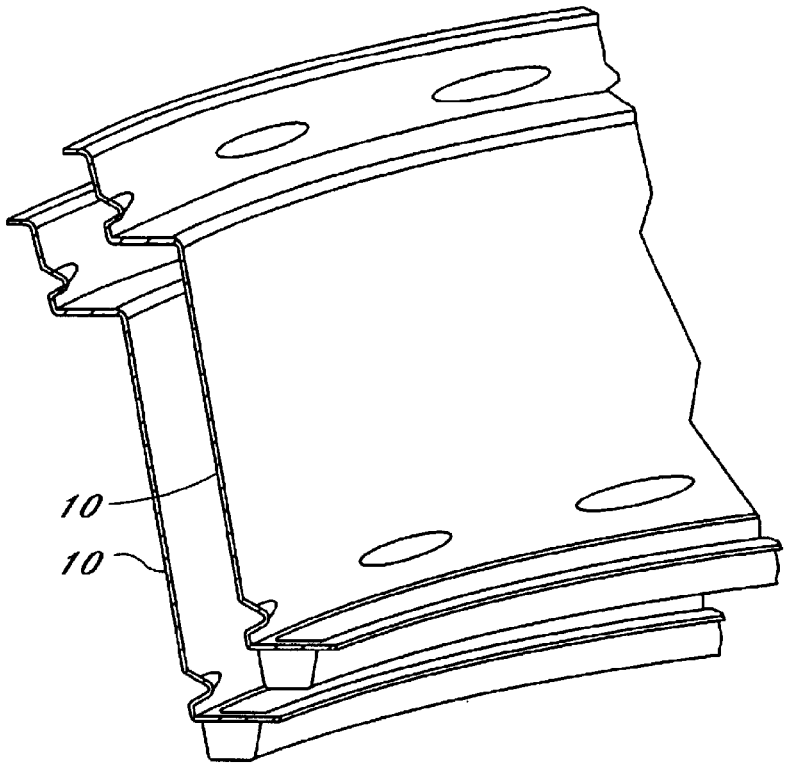
FIG. 4 is a cross sectional perspective view of a first ring frame inserted into a second ring frame of a first embodiment of an advanced food container in accordance with the present invention.
Figure 5:
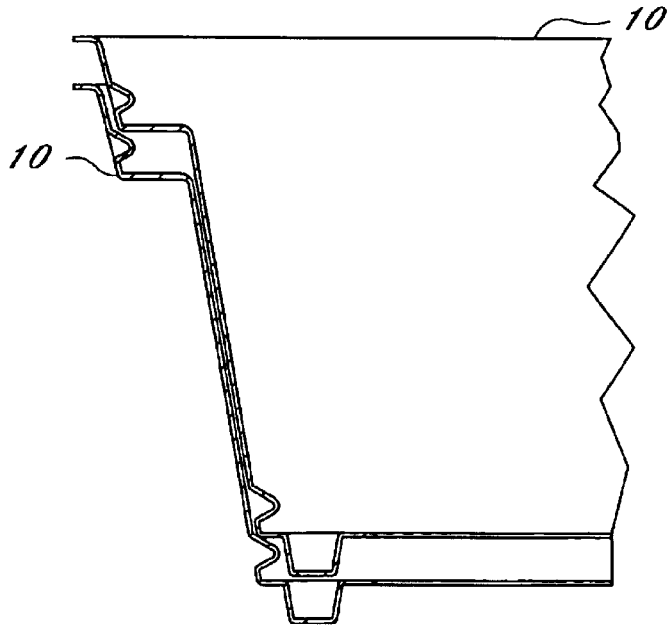
FIG. 5 is a cross sectional view of a first ring frame inserted into a second ring frame of a first embodiment of an advanced food container in accordance with the present invention.
Figure 6:
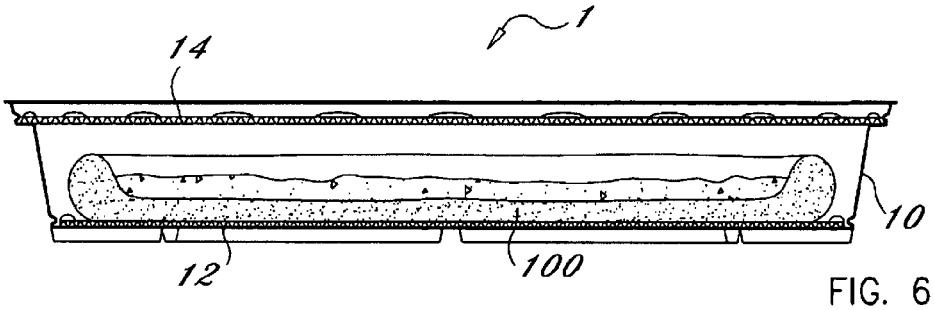
FIG. 6 is a cross sectional view of a first embodiment of an advanced food container retaining a food product in accordance with the present invention.
Figure 7:
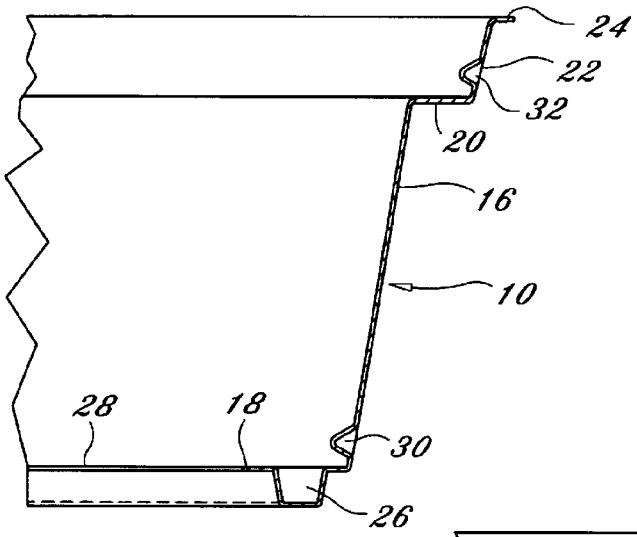
FIG. 7 is a partial cross sectional view of a wall of a ring frame of a first embodiment of an advanced food container in accordance with the present invention.
Figure 8:
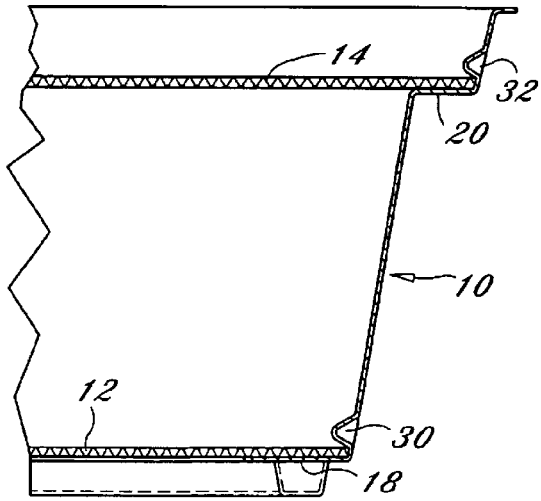
FIG. 8 is a partial cross sectional view of an assembled first embodiment of an advanced food container in accordance with the present invention.
Figure 9:
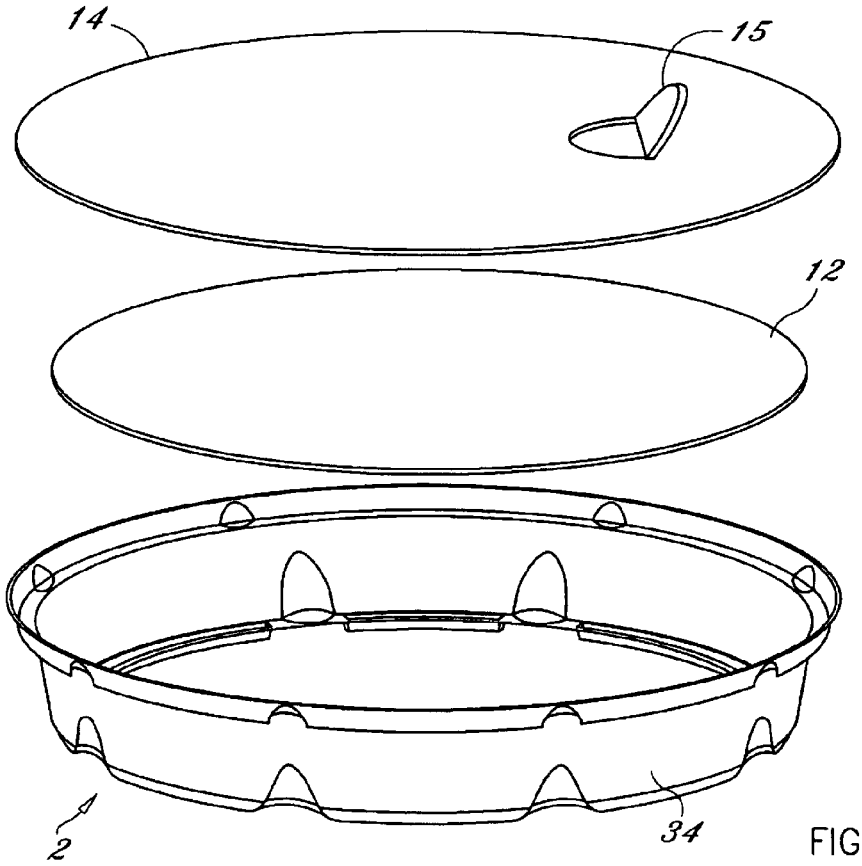
FIG. 9 is an exploded perspective view of a second embodiment of an advanced food container in accordance with the present invention.
Figure 10:
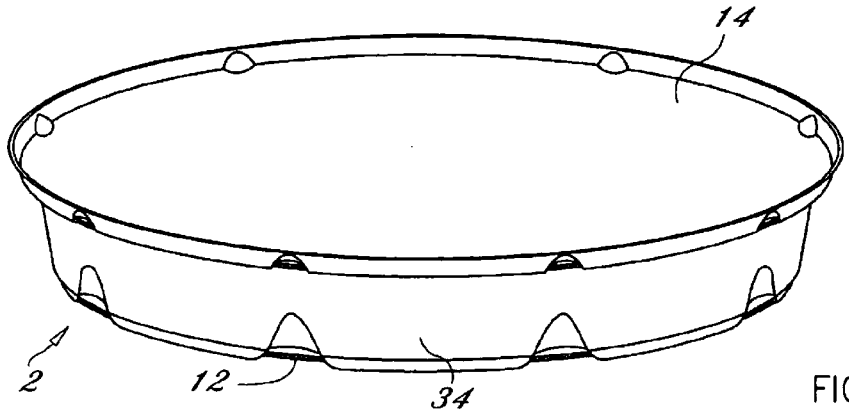
FIG. 10 is a perspective view of an assembled second embodiment of an advanced food container in accordance with the present invention.
Figure 11:
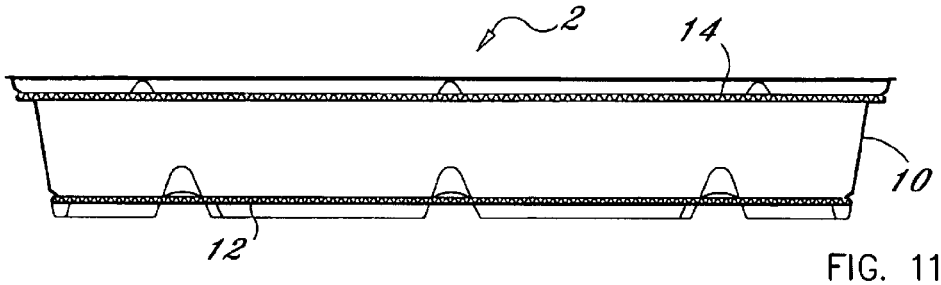
FIG. 11 is a cross sectional view of a second embodiment of an advanced food container in accordance with the present invention.
Figure 12:
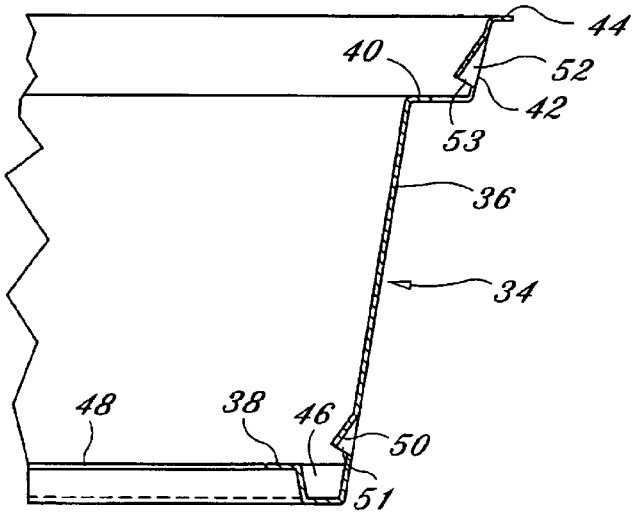
FIG. 12 is a partial cross sectional view of a wall of a ring frame of a second embodiment of an advanced food container in accordance with the present invention.
Figure 13:
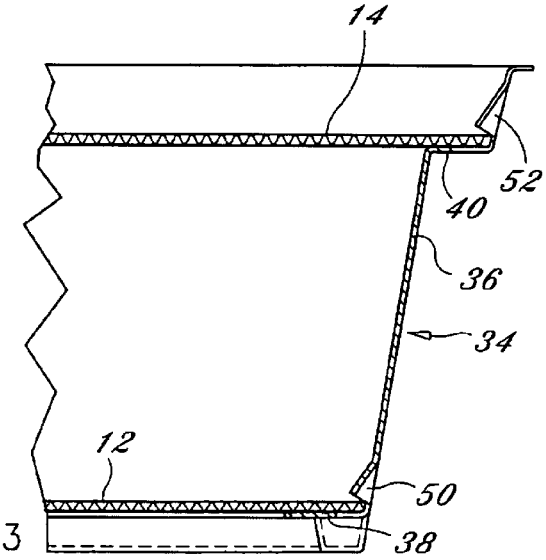
FIG. 13 is a partial cross sectional view of an assembled second embodiment of an advanced food container in accordance with the present invention.
Figure 14:
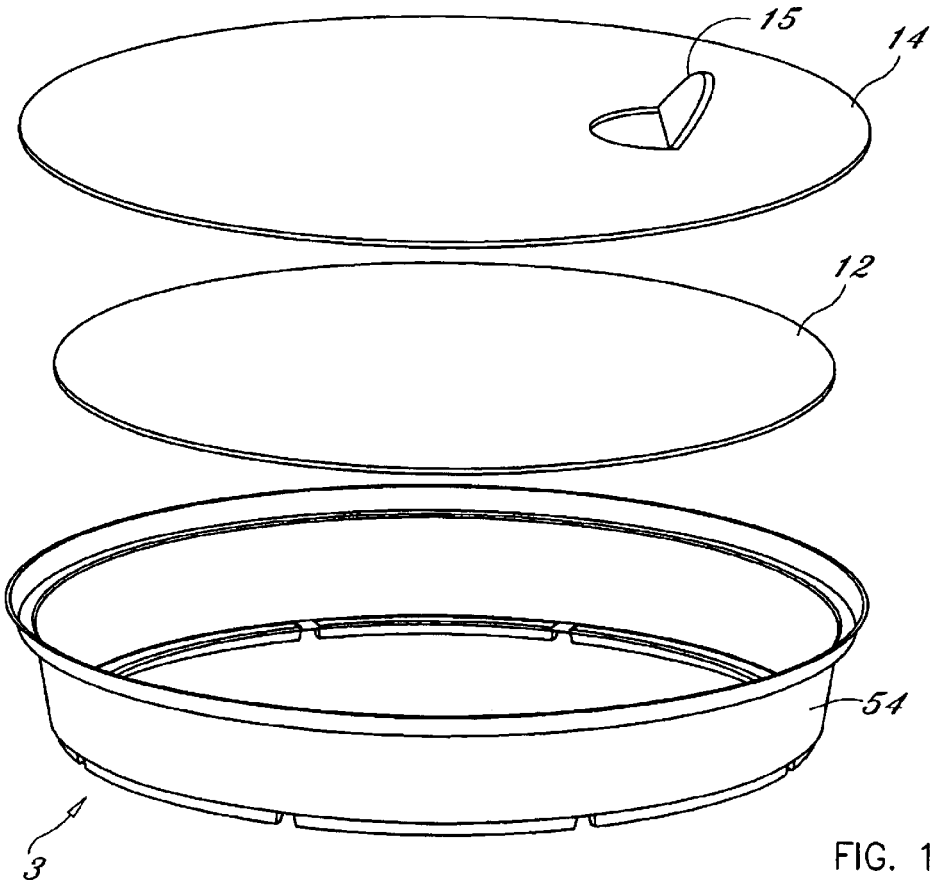
FIG. 14 is an exploded perspective view of a third embodiment of an advanced food container in accordance with the present invention.
Figure 15:
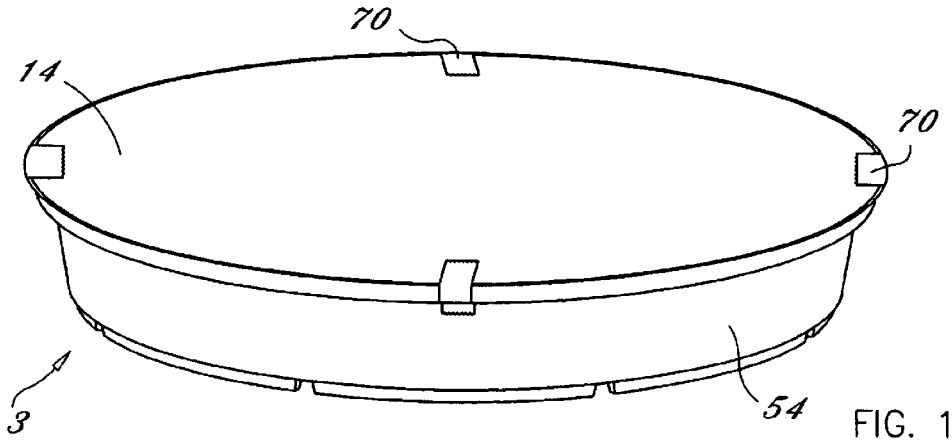
FIG. 15 is a perspective view of an assembled third embodiment of an advanced food container in accordance with the present invention.
Figure 16:
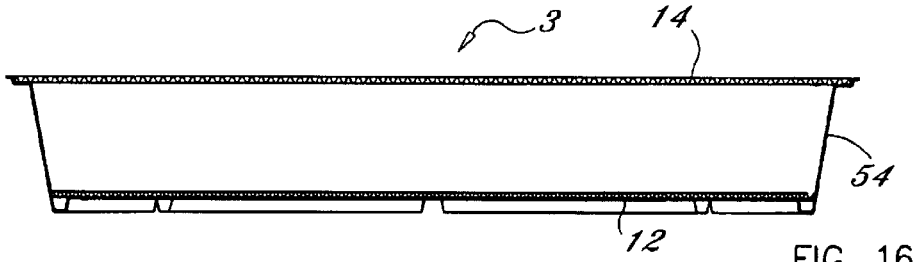
FIG. 16 is a cross sectional view of a third embodiment of an advanced food container in accordance with the present invention.
Figure 17:
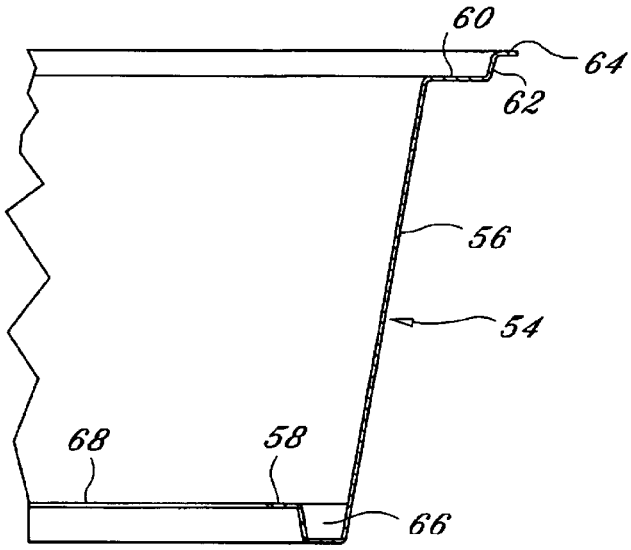
FIG. 17 is a partial cross sectional view of a wall of a ring frame of a third embodiment of an advanced food container in accordance with the present invention.
Figure 18:
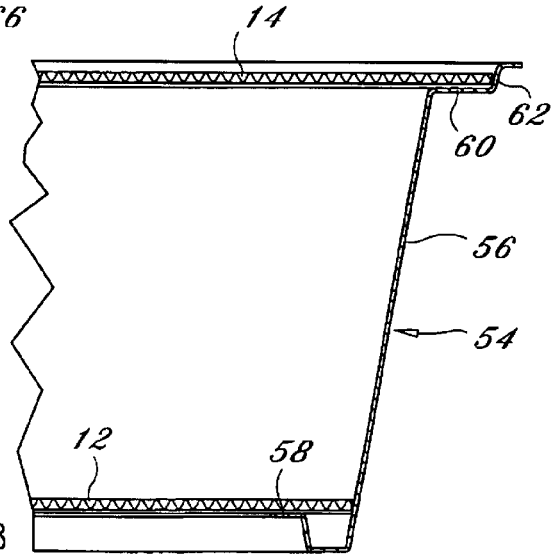
FIG. 18 is a partial cross sectional view of an assembled third embodiment of an advanced food container in accordance with the present invention.
Figure 19:
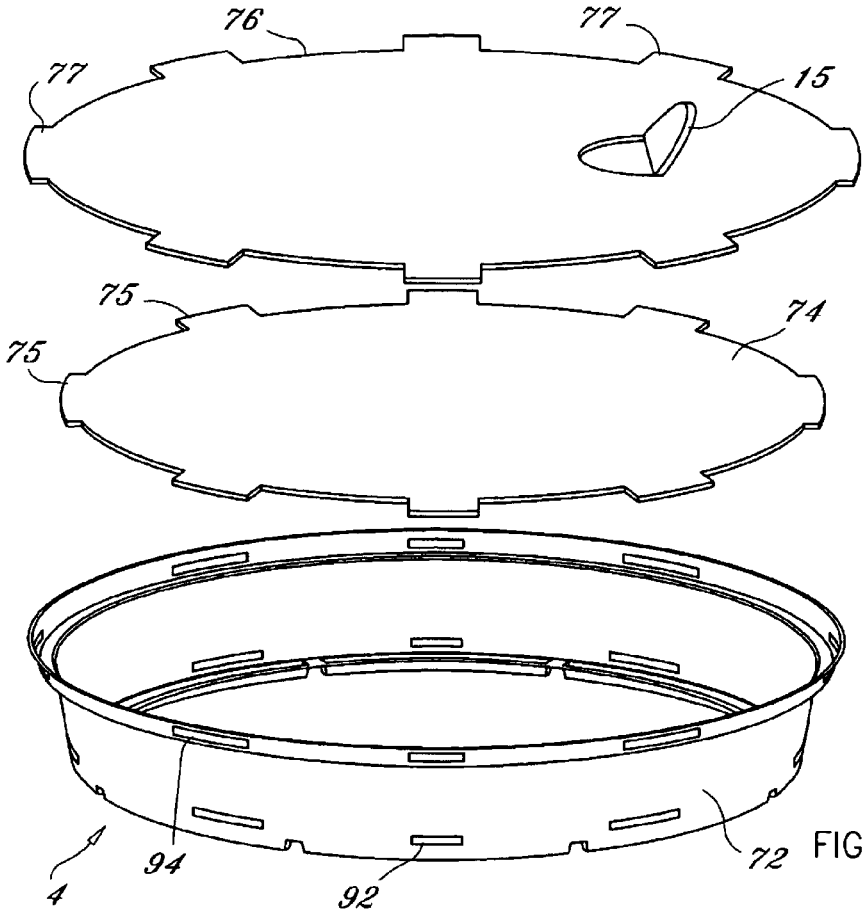
FIG. 19 is an exploded perspective view of a fourth embodiment of an advanced food container in accordance with the present invention.
Figure 20:
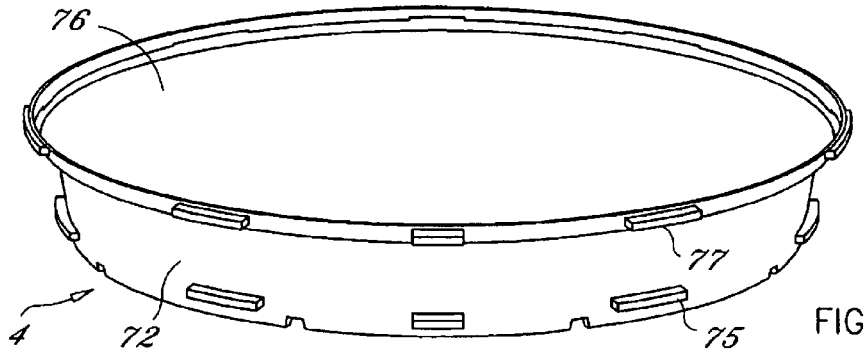
FIG. 20 is a perspective view of an assembled fourth embodiment of an advanced food container in accordance with the present invention.
Figure 21:
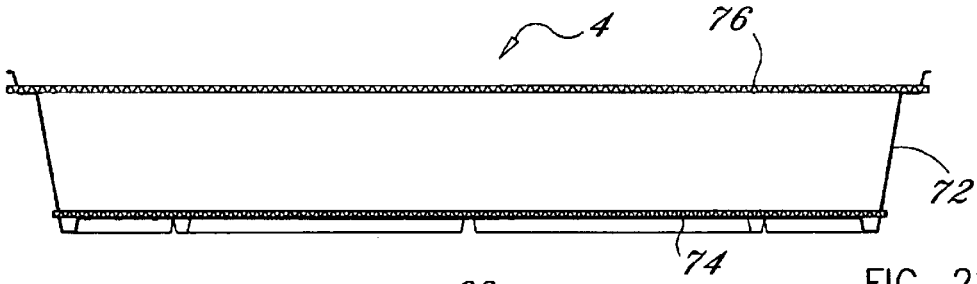
FIG. 21 is a cross sectional view of a fourth embodiment of an advanced food container in accordance with the present invention.
Figure 22:
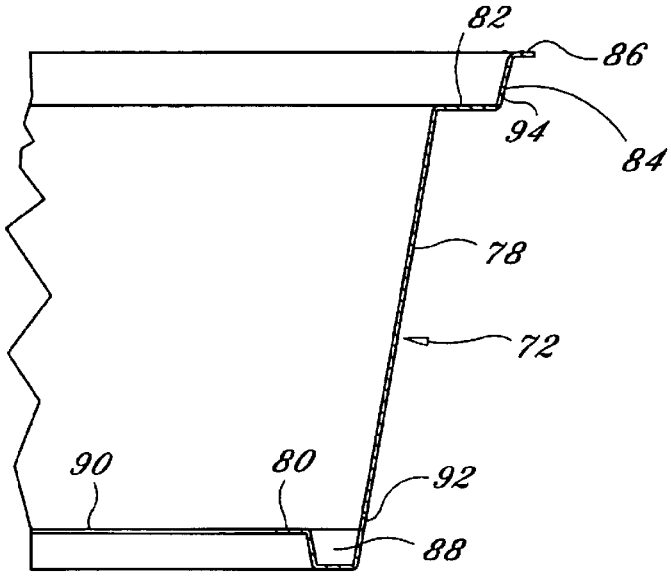
FIG. 22 is a partial cross sectional view of a wall of a ring frame of a fourth embodiment of an advanced food container in accordance with the present invention.
Figure 23:
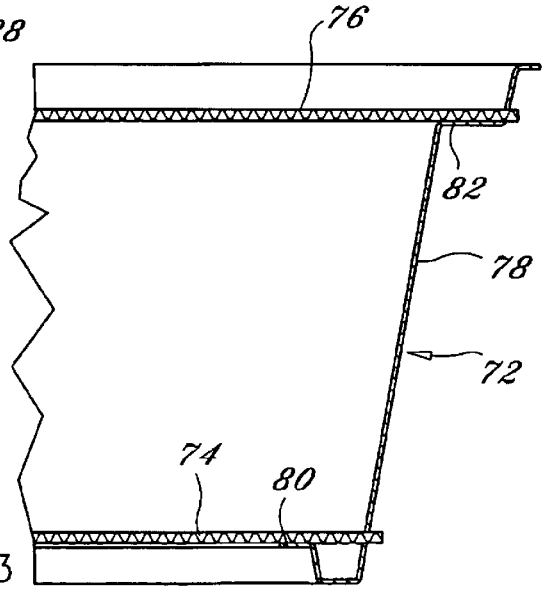
FIG. 23 is a partial cross sectional view of an assembled fourth embodiment of an advanced food container in accordance with the present invention.

With reference now to the drawings, and particularly to FIG. 1, there is shown an exploded perspective view of a first embodiment of an advanced food container 1. With reference to FIGS. 2–8, a first embodiment of an advanced food container 1 includes a ring frame 10, a bottom panel 12, and a removable lid 14. The removable lid 14 preferably includes a tab 15 for removing thereof from a top of the ring frame 10. The tab 15 may be a separate item attached to a top of the removable lid 14, or the tab 15 may be formed as an integral portion of the removable lid 14. However, other devices may be used of the tab 15. The ring frame 10 preferably includes a tapered wall 16, a bottom support surface 18, a lid support surface 20 and an upper wall 22. The perimeter of the ring frame 10 may have a circular, oval, square, or other appropriate shape. The tapered wall 16 enables a plurality of ring frames 10 to be stacked within each other.

The bottom support surface 18 extends inward from substantially a bottom of the tapered wall 16. The lid support surface 20 extends outward from substantially a top of the tapered wall 16. The upper wall 22 extends upward from an outer perimeter of the lid support surface 20. A strengthening edge 24 preferably extends outward from a perimeter of the upper wall 22. The ring frame 10 is preferably fabricated from a plastic material, but other materials may also be used. The bottom panel 12 and the removable lid 14 are preferably fabricated from a corrugated cardboard, but other materials may also be used.

Preferably, at least one foot projection 26 extends from a bottom of the bottom support surface 18. The at least one foot projection 26 is preferably molded as an integral portion of the bottom support surface 18, but other methods of forming the at least one foot projection 26 may also be used. The at least one foot projection 26 creates a gap between a bottom support surface 18 and a support surface (such as a table). An opening 28 may be formed through the bottom support surface 18. An inner perimeter of the tapered wall 16 is sized to receive an outer perimeter of the bottom panel 12. An inner perimeter of the upper wall 22 is sized to receive an outer perimeter of the removable lid 14.

At least one bottom retention projection 30 is formed in the tapered wall 16, adjacent the bottom support surface 18, such that the bottom panel 12 may be retained thereunder. The at least one bottom retention projection 30 is preferably molded as an integral portion of the tapered wall 16, but other methods of forming the at least one bottom retention projection 30 may also be used. At least one lid retention projection 32 is formed in the upper wall 22, adjacent the lid support surface 20, such that the removable lid 14 may be retained thereunder. The at least one lid retention projection 32 is preferably molded as an integral portion of the upper wall 22, but other methods of forming the at least one lid retention projection 32 may also be used.

The advanced food container 1 is preferably assembled in the following manner. First, the bottom panel 12 is pushed into the ring frame 10, until the at least one bottom retention projection 30 is fully snapped over the bottom panel 12. Next, a food item (such as a hot pizza) 100 is placed in the ring frame 10. Finally, the removable lid 14 is pushed on to the lid support surface 20, until the at least one lid retention projection 32 is fully snapped over the removable lid 14. The food item 100 is removed by pulling the tab 15, until the removable lid 14 is removed from under the at least one lid retention projection 32.

With reference to FIGS. 9–13, a second embodiment of an advanced food container 2 includes a ring frame 34, the bottom panel 12, and the removable lid 14. The ring frame 34 preferably includes a tapered wall 36, a bottom support surface 38, a lid support surface 40 and an upper wall 42. The perimeter of the ring frame 34 may have a circular, oval, square, or any other appropriate shape. The tapered wall 36 enables a plurality of ring frames 34 to be stacked within each other.

The bottom support surface 38 extends inward from substantially a bottom of the tapered wall 36. The lid support surface 40 extends outward from substantially a top of the tapered wall 36. The upper wall 42 extends upward from an outer perimeter of the lid support surface 40. A strengthening edge 44 preferably extends from a perimeter of the upper wall 42. The ring frame 34 is preferably fabricated from a plastic material, but other materials may also be used.

Preferably, at least one foot projection 46 extends from a bottom of the bottom support surface 38. The at least one foot projection 46 is preferably molded as an integral portion of the bottom support surface 38, but other methods of forming the at least one foot projection 46 may also be used. The at least one foot projection 46 creates a gap between a bottom support surface 38 and a support surface (such as a table). An opening 48 may be formed through the bottom support surface 38. An inner perimeter of the tapered wall 36 is sized to receive an outer perimeter of the bottom panel 12. An inner perimeter of the upper wall 42 is sized to receive an outer perimeter of the removable lid 14.

A plurality of bottom retention protrusions 50 are formed in the tapered wall 36, adjacent the bottom support surface 38, such that the bottom panel 12 may be retained thereunder. A plurality of bottom retention slots 51 are formed between the bottom support surface 38 and the plurality of bottom retention protrusions 50. Each bottom retention slot 51 is sized to receive a thickness of the bottom panel 12. The plurality of bottom retention protrusions and slots are preferably molded as an integral portion of the tapered wall 36. However, the plurality of bottom retention protrusions 50 may be molded and the plurality of bottom retention slots 51 cut with a shear punch, but other methods of forming the plurality of bottom retention protrusions and slots may also be used.

A plurality of lid retention protrusions 52 are formed in the upper wall 42, adjacent the lid support surface 40, such that the removable lid 14 may be retained thereunder. A plurality of lid retention slots 53 are formed between the lid support surface 40 and the plurality of lid retention protrusions 52. Each lid retention slot 53 is sized to receive a thickness of the removable lid 14. The plurality of lid retention protrusions and slots are preferably molded as an integral portion of the upper wall 42. However, the plurality of lid retention protrusions 52 may be molded and the plurality of lid retention slots 53 cut with a shear punch, but other methods of forming the plurality of lid retention protrusions and slots may also be used.

The advanced food container 2 is preferably assembled in the following manner. First, the bottom panel 12 is pushed into the ring frame 34, until the bottom panel 12 snaps into the plurality of bottom retention slots 51. Next, a food item is placed in the ring frame 34. Finally, the removable lid 14 is pushed on to the lid support surface 40, until the removable lid 14 is snapped into the plurality of lid retention slots 53. The food item is removed by pulling the tab 15, until the removable lid 14 is removed from the plurality of lid retention slots 53.

With reference to FIGS. 14–18, a third embodiment of an advanced food container 3 includes a ring frame 54, the bottom panel 12, and the removable lid 14. The ring frame 54 preferably includes a tapered wall 56, a bottom support surface 58, a lid support surface 60 and an upper wall 62. The perimeter of the ring frame 54 may have a circular, oval, square, or any other appropriate shape. The tapered wall 56 enables a plurality of ring frames 54 to be stacked within each other.

The bottom support surface 58 extends inward from substantially a bottom of the tapered wall 56. The lid support surface 60 extends outward from substantially a top of the tapered wall 56. The upper wall 62 extends upward from an outer perimeter of the lid support surface 60. A strengthening edge 64 preferably extends outward from a perimeter of the upper wall 62. The ring frame 54 is preferably fabricated from a plastic material, but other materials may also be used.

Preferably, at least one foot projection 66 extends from a bottom of the bottom support surface 58. The at least one foot projection 66 is preferably molded as an integral portion of the bottom support surface 58, but other methods of forming the at least one foot projection 66 may also be used. The at least one foot projection 66 creates a gap between a bottom support surface 58 and a support surface (such as a table). An opening 68 may be formed through the bottom support surface 58. An inner perimeter of the tapered wall 56 is sized to receive an outer perimeter of the bottom panel 12. An inner perimeter of the upper wall 62 is sized to receive an outer perimeter of the removable lid 14.

The advanced food container 3 is preferably assembled in the following manner. First, the bottom panel 12 is attached to the bottom support surface 58 with an adhesive, double backed tape or the like. Next, a food item is placed in the ring frame 54. Finally, the removable lid 14 is retained on the lid support surface 60 with at least one piece of tape 70 or the like. The food item is extracted by removing the at least one piece of tape 70 and pulling the tab 15, until the removable lid 14 is removed from the ring frame 54.

With reference to FIGS. 19–23, a fourth embodiment of an advanced food container 4 includes a ring frame 72, a bottom panel 74, and a removable lid 76. The bottom panel 74 includes a plurality of peripheral panel projections 75 formed on a perimeter thereof. The removable lid 76 includes a plurality of peripheral lid projections 77 formed on a perimeter thereof. The ring frame 72 preferably includes a tapered wall 78, a bottom support surface 80, a lid support surface 82 and an upper wall 84. The perimeter of the ring frame 72 may have a circular, oval, square, or any other appropriate shape. The tapered wall 78 enables a plurality of ring frames 72 to be stacked within each other. The bottom panel 74 and the removable lid 76 are preferably fabricated from a corrugated cardboard, but other materials may also be used.

The bottom support surface 80 extends inward from substantially a bottom of the tapered wall 78. The lid support surface 82 extends outward from substantially a top of the tapered wall 78. The upper wall 84 extends upward from an outer perimeter of the lid support surface 82. A strengthening edge 86 preferably extends outward from a perimeter of the upper wall 84. The ring frame 72 is preferably fabricated from a plastic material, but other materials may also be used.

Preferably, at least one foot projection 88 extends from a bottom of the bottom support surface 80. The at least one foot projection 88 is preferably molded as an integral portion of the bottom support surface 80, but other methods of forming the at least one foot projection 88 may also be used. The at least one foot projection 88 creates a gap between a bottom support surface 80 and a support surface (such as a table). An opening 90 may be formed through the bottom support surface 80. An inner perimeter of the tapered wall 78 is sized to receive a panel perimeter of the bottom panel 74. An inner perimeter of the upper wall 84 is sized to receive a lid perimeter of the removable lid 76.

A plurality of panel slots 92 are formed in the tapered wall 78, adjacent the bottom support surface 80, such that the bottom panel 74 may be retained therein. Each bottom retention slot 92 is sized to receive a single peripheral panel projection 75. A plurality of lid slots 94 are formed in the upper wall 84, adjacent the lid support surface 82, such that the removable lid 76 may be retained therein. Each lid slot 94 is sized to receive a single peripheral lid projection 77. The plurality of panel and lid slots are preferably molded as an integral portion of the tapered wall 78, but could be sheared with a punch. However, other methods of forming the plurality of panel and lid slots may also be used.

The advanced food container 4 is preferably assembled in the following manner. First, one of the plurality of peripheral panel projections 75 is inserted into one of the plurality of panel slots 92 and the remaining peripheral panel projections 75 are snapped into the remaining panel slots 92. Next, a food item is placed in the ring frame 72. Finally, one of the plurality of peripheral lid projections 77 is inserted into one of the plurality of lid slots 94 and the remaining peripheral lid projections 77 are snapped into the remaining lid slots 94. The food item is removed by pulling the tab 15, until the removable lid 76 is removed from the plurality of lid slots 94.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the spirit and scope of the invention.

I claim:

1. A method of creating an advanced food container, comprising the steps of;

providing a ring frame having a tapered wall;

forming a bottom support surface on substantially a bottom of said tapered wall;

forming a lid support surface on substantially a top of said tapered wall, extending an upper wall from said lid support surface;

providing a bottom panel;

providing at least one bottom retention projection for retaining said bottom panel in said tapered wall;

providing a removable lid; and forming providing at least one lid retention projection for retaining said removable lid in said upper wall.

2. The method of creating an advanced food container of claim 1, further comprising the step of:

forming at least one foot on said bottom support surface.

3. The method of creating an advanced food container of claim 1, further comprising the step of:

forming a lifting tab on said removable lid.

4. The method of creating an advanced food container of claim 1, further comprising the step of:

forming a strengthening edge on an outer perimeter of said upper wall.

5. The method of creating an advanced food container of claim 1, further comprising the step of;

providing said ring frame with a round perimeter.

6. A method of creating an advanced food container, comprising the steps of:

providing a ring frame having a tapered wall;

forming a bottom support surface on substantially a bottom of said tapered wall;

forming a lid support surface on substantially a top of said tapered wall, extending an upper wall from said lid support surface;

providing a bottom panel;

providing at least one bottom retention protrusion for retaining said bottom panel in said tapered wall;

providing a removable lid; and providing at least one lid retention protrusion for retaining said removable lid in said upper wall.

7. The method of creating an advanced food container of claim 6, further comprising the step of:

forming at least one foot on said bottom support surface.

8. The method of creating an advanced food container of claim 6, further comprising the step of:

forming a lifting tab on said removable lid.

9. The method of creating an advanced food container of claim 6, further comprising the step of:

forming a strengthening edge on an outer perimeter of said upper wall.

10. The method of creating an advanced food container of claim 6, further comprising the step of:

providing said ring frame with a round perimeter.

11. A method of creating an advanced food container, comprising the steps of:

providing a ring frame having a tapered wall;

forming a bottom support surface on substantially a bottom of said tapered wall, forming at least one foot on said bottom support surface;

forming a lid support surface on substantially a top of said tapered wall, extending an upper wall from said lid support surface;

providing a bottom panel;

providing at least one bottom retention projection for retaining said bottom panel in said tapered wall;

providing a removable lid; and providing at least one lid retention projection for retaining said removable lid in said upper wall.

12. The method of creating an advanced food container of claim 11, further comprising the step of:

forming a lifting tab on said removable lid.

13. The method of creating an advanced food container of claim 11, further comprising the step of:

forming a strengthening edge on an outer perimeter of said upper wall.

14. The method of creating an advanced food container of claim 11, further comprising the step of:

providing said ring frame with a round perimeter.

* * * * *